US005859617A

United States Patent [19]

Fujikawa

[11] Patent Number: 5,859,617

[45] Date of Patent: Jan. 12, 1999

[54] EXTENDABLE ROD ANTENNA AND HELICAL ANTENNA WITH FREQUENCY ADJUSTING CONDUCTOR

[75] Inventor: Hiroshi Fujikawa, Tokyo, Japan

[73] Assignee: SMK Corporation, Tokyo, Japan

[21] Appl. No.: 776,655

[22] PCT Filed: Jun. 28, 1996

[86] PCT No.: PCT/JP96/01805

§ 371 Date: Feb. 7, 1997

§ 102(e) Date: Feb. 7, 1997

[87] PCT Pub. No.: WO97/02622

PCT Pub. Date: Jan. 23, 1997

[30] Foreign Application Priority Data

Jun. 30, 1995 [JP] Japan ..... 7-186697

[51] Int. Cl.[6] ..... H01Q 1/24

[52] U.S. Cl. ..... 343/702; 343/895; 343/900

[58] Field of Search ..... 343/702, 900, 343/901, 725, 895; H01Q 1/24

[56] References Cited

U.S. PATENT DOCUMENTS

| | | | |
|---|---|---|---|
| 4,868,576 | 9/1989 | Johnson | 343/702 |
| 5,446,469 | 8/1995 | Makino | 343/702 |
| 5,479,178 | 12/1995 | Ha | 343/702 |
| 5,594,457 | 1/1997 | Wingo | 343/702 |
| 5,661,495 | 8/1997 | Saldell | 343/702 |

FOREIGN PATENT DOCUMENTS

| | | |
|---|---|---|
| 0 650 215 A2 | 4/1995 | European Pat. Off. . |
| 2 253 949 A | 9/1992 | United Kingdom . |

OTHER PUBLICATIONS

Patent Abstracts of Japan, vol. 18, No. 577(E–1625) Nov. 4, 1994 (JP, A, 06216630, Aug. 1994).

*Primary Examiner*—Michael C. Wimer

*Attorney, Agent, or Firm*—Armstrong, Westerman, Hattori, McLeland & Naughton

[57] ABSTRACT

The invention is directed to an antenna assembly which, when a rod antenna unit is retracted in the radio housing, permits transmission and reception with no influence thereon by the retracted rod antenna unit and which resonates with two frequencies when the rod antenna unit is in its extended position. Feeding metal pipe (9) connected to a secondary antenna (14) formed by a helical antenna element has contact springs (18) for elastic contact with a rod antenna unit (2). When the rod antenna unit (2) is retracted position, the contact springs (18) contact an insulating cover (11) wrapped around the rod antenna unit (2), electrically disconnecting a primary antenna (20) from the feeding metal pipe (9). Hence, only the secondary antenna (14) serves as an antenna without being affected by the primary antenna (20). When the rod antenna unit (2) is in its extended position, the contact springs (18) make electrical contact with a connector terminal (22) electrically connected to the primary antenna (20), thus connecting the primary antenna (20) and the secondary antenna (14) to the feeding hardware (9).

5 Claims, 8 Drawing Sheets

EXTENDABLE ROD ANTENNA AND HELICAL ANTENNA WITH FREQUENCY ADJUSTING CONDUCTOR

TECHNICAL FIELD

The present invention relates to an antenna assembly for portable radios such as portable telephones and, more particularly, to an antenna assembly with its antenna telescopically received in the radio housing.

BACKGROUND ART

Portable radios, such as portable telephones, are usually designed to hold the antenna at its retracted position in their housing on the move to make them as compact in size as possible.

With the antenna retracted in the radio housing, however, portable radios of this kind cannot accomplish satisfactory transmission and reception, and the sensitivity for receiving call signals is particularly low. Hence, it is necessary in the prior art to hold the antenna in its extended position while awaiting a call.

As a solution to this problem, there has been developed an antenna unit which permits transmission and reception even with a rod antenna unit retracted in the radio housing, as described in Japanese Pat. Laid-Open Gazette No. 245603/91.

This conventional antenna assembly will be described below with reference to FIGS. 10 to 12.

As shown in FIG. 10, the antenna assembly has its feeding metal pipe mounted on the top of a housing 101 of a portable radio 110 and its rod antenna element 103 adapted to be pushed into and drawn out of the radio housing 101 through a through hole bored in the feeding metal pipe 102.

The rod antenna element 103 carries at its tip a helical antenna element 104. Since the rod antenna element 103 and the helical antenna 104 each have a length equal to the quarter wavelength of a radio signal of a frequency f, a half-wave antenna is formed when the rod antenna element 103 is drawn out of the radio housing 101 to its extended position.

In this state, the lower end portion of the rod antenna element 103 makes electrical contact with the feeding metal pipe 102, which is connected via a feeder 105 to a transmitter-receiver circuit (not shown) on a circuit board 106.

When the rod antenna element 103 is retracted in the radio housing 101, the junction between the rod antenna element 103 and the helical antenna 104 makes contact with the feeding metal pipe 102 and the helical antenna element 104 projecting out of the radio housing 101 functions as a quarter-wave antenna.

Accordingly, even with the rod antenna element 103 retracted in the radio housing 101, the portable radio 110 can transmit and receive radio signals of the frequency f.

As described above, the conventional antenna unit permits transmission and reception even when the rod antenna element 103 is retracted in the radio housing 101, but the rod antenna element 103 is still held in contact with the feeding metal pipe 102; hence, when the portable radio 110 transmits, high-frequency signals also emanate from the rod antenna element 103 and cause noise, adversely affecting respective circuits in the radio housing 101.

Also when receiving with the rod antenna element 103 retracted in the radio housing 101, the wavelength of the helical antenna element 104 deviates from the quarter wavelength under the influence of the rod antenna element 103, impairing the sensitivity to incoming signals.

To avoid this, in the above prior art example the lower end portion 103 a of the rod antenna element 103, when retracted, is held in contact with a grounding segment 107 as shown in FIG. 13, by which the impedance viewed from the feeding metal pipe 102 is made infinity, preventing the rod antenna element 103 from functioning as an antenna.

To ground the lower end portion 103 a of the rod antenna element 103, however, it is necessary to provide an extra grounded circuit as well as the grounding segment 107. This inevitably introduces complexity in the antenna structure.

Further, since the rod antenna element 103, when retracted in the radio housing 101, is supported at its upper end by the feeding metal pipe 102 alone, the lower end portion 103*a* is unstable in position and fail to contact the grounding segment 107.

Moreover, with an increase in the frequency f of the radio signal for transmission and reception by the portable radio 110, the influence of R and L components of the feeding metal pipe 102 and other parts becomes increasingly non-negligible. It is not an easy task to make the resonance frequency of the helical antenna element 104 match the frequency f of the radio signal by adjusting the length of the helical antenna element 104.

Additionally, even when the rod antenna element 103 is in its extended position as shown in FIG. 11, only one resonance frequency is available; hence, when the receive frequency and the transmit frequency differ as in the case of the portable telephone, high sensitivity for reception and large radiated power for transmission cannot be obtained.

Incidentally, there is also known antenna unit of the type that permits transmission and reception only by the helical antenna element 104 projecting out of the radio housing 101 but as is the case with the above-mentioned prior art example, this antenna unit does not provide two resonance frequencies either, and hence it fails to obtain high sensitivity for reception and large radiated power for transmission.

DISCLOSURE OF INVENTION

It is therefore an object of the present invention to provide an antenna assembly for portable radios which has its rod antenna element adapted to be telescopically or slidably retracted in the radio housing and permits transmission and reception free from the influence of noise from the rod antenna element held in its retracted position and provides two resonance frequencies when the rod antenna element is in its extended position.

According to a first aspect of the present invention, the antenna assembly comprises: a rod antenna unit composed of a primary antenna formed by a rod antenna element, an insulating cover covering the primary antenna at least at its lower end portion, and a connector terminal secured to the lower end portion of the primary antenna, the primary antenna, the insulating cover and the connector terminal being axially aligned; feeding metal pipe fitted in the top of the radio housing, and having a centrally-disposed through hole for slidably or telescopically receiving said rod antenna unit between its extended and retracted positions, and having contact springs for elastically contacting the outer peripheral surface of the rod antenna unit; and a secondary antenna formed by a helical antenna element and fixed at its lower end to the feeding metal pipe. When the rod antenna unit is retracted in the radio housing, the contact springs contact the insulating cover around the rod antenna assembly, cutting off the electrical connections between the feeding metal pipe and the primary antenna.

When the rod antenna unit is drawn out of the radio housing to the extended position, the contact springs electrically contact the connector terminal of the rod antenna unit electrically connecting both the primary antenna and the secondary antenna to the feeding metal pipe.

According to a second aspect of the present invention, a cylindrical insulating cap is mounted on the feeding metal pipe around the secondary antenna and the upper end portion of the insulating cover forms a stopper larger in diameter than a through hole of the insulating cap.

According to a third aspect of the present invention, the connector terminal is composed of a sheath-like support potion for insertion into the through hole and a stopper larger in diameter than the support portion, and when the rod antenna unit is drawn out of the radio housing to the extended position, the stopper abuts against the lower end face of the feeding metal pipe.

According to a fourth aspect of the present invention, a frequency adjusting conductor is wrapped around the insulating cover for contact with the contact springs to adjust the receive frequency of the secondary antenna when the rod antenna unit is retracted in the radio housing.

According to a fifth aspect of the present invention, the contact springs are protrusive inward from the body of the cylindrical spring structure, and the cylindrical spring structure is fitted in an annular groove cut in the interior surface of said feeding metal pipe.

According to a sixth aspect of the present invention, the contact springs are each a tongue-like segment formed integrally with the feeding metal pipe and extending therefrom in a cantilever fashion for elastic contact with the outer peripheral surface of the rod antenna unit.

In the first aspect of the invention, the rod antenna unit is retracted into or drawn out of the radio housing through the feeding metal pipe mounted on the housing.

The contact springs elastically contact the outer peripheral surface of the rod antenna unit to hold it in its retracted or extended position.

When the rod antenna is retracted in the radio housing, the contact springs contact the insulating cover covering the rod antenna element, cutting off the electrical connections between the primary antenna and the feeding metal pipe. In consequence, only the secondary antenna protruding out of the radio housing is electrically connected to the feeding metal pipe and serves as an antenna of the portable radio.

When the rod antenna unit is in its extended position, the contact springs contact the connector terminal secured to the lower end portion of the rod antenna unit establishing electrical connections between the primary antenna and the feeding hardware.

Thus, since the secondary antenna, which remains protruding from the radio housing when the rod antenna unit is retracted therein, is formed by a helical antenna element, it does not so much stick out as to impair the carryability of the portable radio.

When the rod antenna unit is retracted in the radio housing, the secondary antenna still remains protruding therefrom and enables the portable radio to accomplish transmission and reception, in particular, the reception of call signals. Hence, the rod antenna unit need not be held in its extended position while awaiting a call.

When the rod antenna unit is retracted in the radio housing, the contact springs contact the insulating cover of the rod antenna unit and consequently, the primary antenna need not be contacted with a grounding segment or the like, and such elements as the grounding segment and the grounding circuit can be dispensed with.

Further, the primary antenna retracted in the radio housing is completely insulated from the feeding metal pipe. Accordingly, during transmission the primary antenna does not radiate high-frequency signals which adversely affect, as noise, respective circuits in the radio housing. Nor does it exert any influence on the secondary antenna during reception, and hence the sensitivity to incoming signals does not decrease.

On the other hand, when the rod antenna unit is in its extended position the primary and secondary antennas and are electrically connected to the feeding hardware, constituting two-frequency antenna assembly which has two resonance frequencies.

By setting one of the two antennas to the transmit frequency f2 of the portable radio and the other to the receive frequency f1, it is possible to constitute an antenna assembly of large radiated power for transmission and high sensitivity for reception.

Moreover, since the primary and secondary antennas and both stick out of the radio housing, it is possible to obtain an antenna assembly of high sensitivity and large radiated power.

Additionally, when held in its retracted and extended states, the rod antenna unit would not move up and down, because the contact springs elastically contact its outer peripheral surface to grip the element.

In the second aspect of the invention, when the rod antenna unit is retracted into the radio housing, the stopper at its top end abuts against the upper end face of the insulating cap, preventing the rod antenna unit from falling into the radio housing. With the above stopper abutting against the insulating cap, it is possible to define the position on the outer peripheral surface of the rod antenna unit with which the contact springs make elastic contact when the rod antenna unit is held in its retracted position.

According to the second aspect of the present invention, since the top end portion of the insulating cover is formed as the stopper for preventing the rod antenna unit from falling into the radio housing, there is no need of separately providing such a stopper and the number of parts used does not increase accordingly.

Further, when the rod antenna unit is retracted in the radio housing, the position where the stopper abuts against the top edge of the insulating cap defines the position of contacting the contact springs with the outer peripheral surface of the rod antenna unit; hence, the primary antenna can be surely insulated by covering it at the defined position with the insulating cover.

According to the third aspect of the present invention, when the rod antenna unit is drawn out of the radio housing, the stopper abuts against the lower end face of the feeding metal pipe, preventing the rod antenna unit from coming out of the radio housing.

Since the position where the stopper against the lower end face of the feeding metal pipe defines the position where to contact the contact springs with the outer peripheral surface of the rod antenna unit when extended, the contact springs and the primary antenna can surely be electrically connected by covering the rod antenna unit at that defined position with the support portion of the connector terminal.

Additionally, since the support portion of the connector terminal is snugly received in the through hole, the rod antenna unit sticking out of the radio housing can be supported stable.

In the fourth aspect of the invention, when the rod antenna unit is retracted in the radio housing, the frequency adjusting conductor is electrically connected via the contact springs to the secondary antenna, changing its resonance frequency.

According to the fourth aspect of the present invention, since the frequency adjusting conductor is electrically connected to the secondary antenna when the rod antenna unit is retracted in the radio housing, the resonance frequency of the secondary antenna can easily be adjusted by replacing the frequency adjusting conductor with a proper one.

By electrically connecting the frequency adjusting conductor to the secondary antenna when the rod antenna unit is retracted in the radio housing, the resonance frequency of the secondary antenna can be made to match the resonance frequency of the primary antenna in its extended position. Thus, by setting this resonance frequency at the receive frequency f1 of the portable radio the secondary antenna is allowed to have high sensitivity for reception irrespective of whether the rod antenna unit is extended or retracted.

Besides, by selectively using different frequency adjusting conductor, the resonance frequency of the secondary antenna made to match the transmit frequency f2 in the rod antenna unit extended state can also be shifted to the intermediate between the transmit and receive signals f2 and f1 when the rod antenna unit is retracted in the radio housing. By changing the resonance frequency of the secondary antenna in this way, it is possible to obtain high sensitivity for reception with the secondary antenna in the rod antenna assembly extended state and to accomplish transmission and reception via the secondary antenna in the rod antenna unit retracted state.

In the fifth aspect of the invention, contact springs contact the outer peripheral surface of the rod antenna unit at different circumferential positions, supporting the rod antenna unit uniformly around it. At the same time, the contact springs contacts its connector terminal, ensuring establishing therebetween electrical connections.

The cylindrical spring structure with the contact springs can easily be fitted into the annular groove of the feeding metal pipe.

Since the cylindrical spring structure is easily attachable to and detachable from the feeding metal pipe, it can readily be replaced with a new one when the contact springs are deformed.

In the sixth aspect of the invention, the contact springs contact the outer peripheral surface of the rod antenna unit at different positions along its circumference and holds it uniformly around it. At the same time, the contact springs contact the connector terminal of the rod antenna unit, surely establishing therebetween electrical connections.

The integral structure of the contact springs with the feeding metal pipe simplifies the assembling of the antenna assembly with causing an increase in the number of parts used.

BRIEF DESCRIPTION OF DRAWINGS

FIG. 7 (*b*) is an equivalent circuit of the antenna assembly with the rod antenna unit held in its extended position;

FIG. 7 (*c*) is a graph showing the frequency characteristic of the antenna assembly when the rod antenna unit is held in its retracted position;

FIG. 7 (*d*) is a graph showing the frequency characteristic of the antenna assembly when the rod antenna unit is held in its extended position 1.

BEST MODE FOR CARRYING OUT THE INVENTION

Referring first to FIGS. 1 to 7, an embodiment of the present invention will be described.

Figure 6:
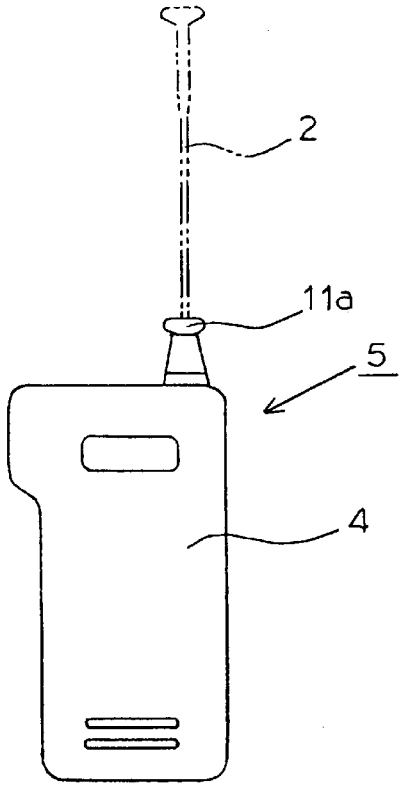
FIG. 6 is a front view of a portable radio 5 with the antenna assembly of the present invention built therein.
Figure 7A:
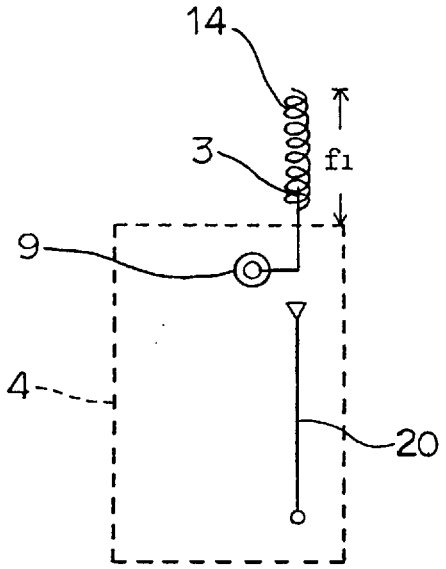
FIG. 7 (*a*) is an equivalent circuit of the antenna assembly with the rod antenna unit held in its retracted position.
Figure 7B:
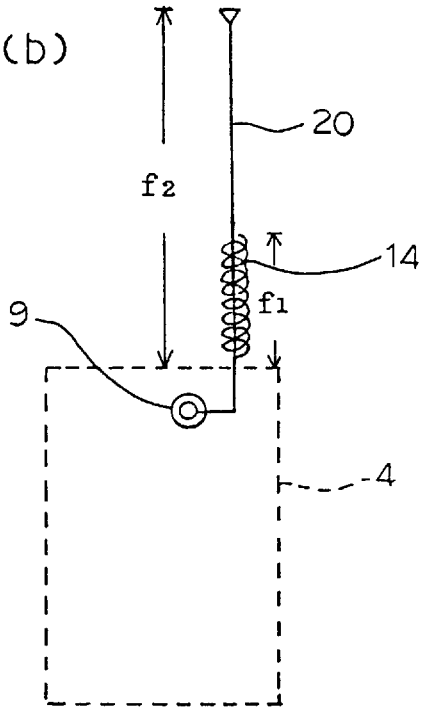
Figure 7C:
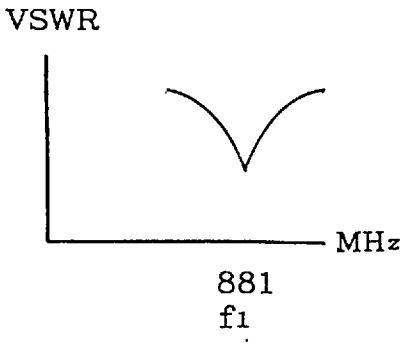
Figure 7D:
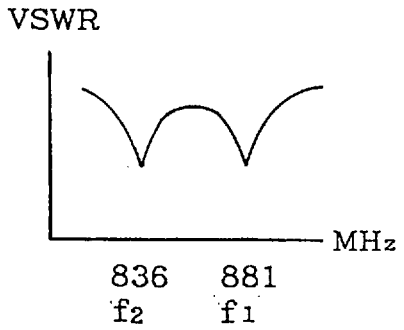

As depicted in FIG. 6, the antenna assembly of this embodiment is adapted so that while a portable radio 5 is on the move, a rod antenna unit 2 is held in a radio housing 4 with a stopper 11 a left remaining thereon.

For ordinary communication, the stopper 11 a is picked up to raise the rod antenna unit 2 from its retracted position in the housing 4 to its uppermost extended position as indicated by the two-dot chain lines in FIG. 6.

Figure 1:
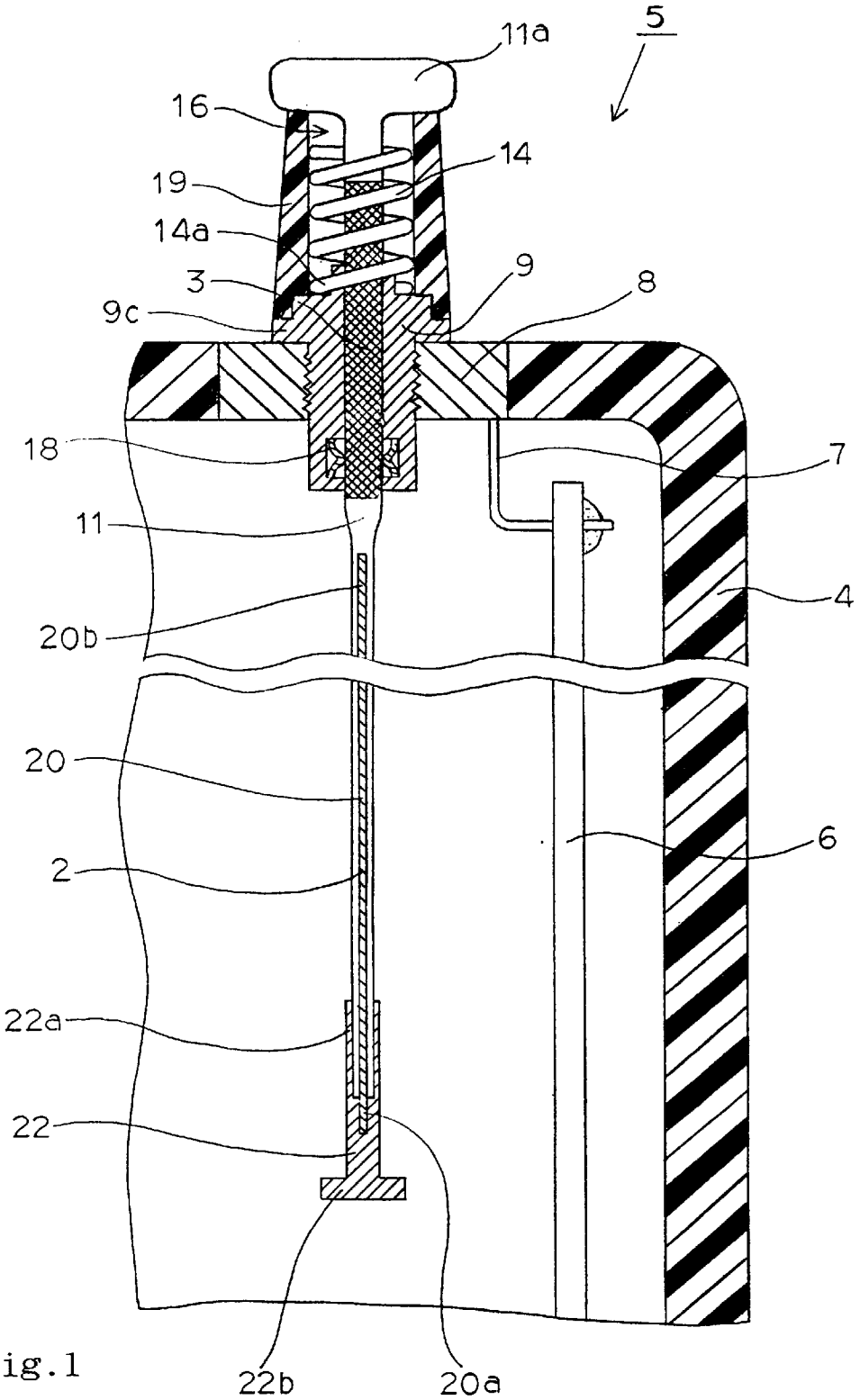
FIG. 1 is a sectional view illustrating the principal part of the antenna assembly according to an embodiment of the present invention, with the rod antenna unit held in its retracted position.
Figure 2:
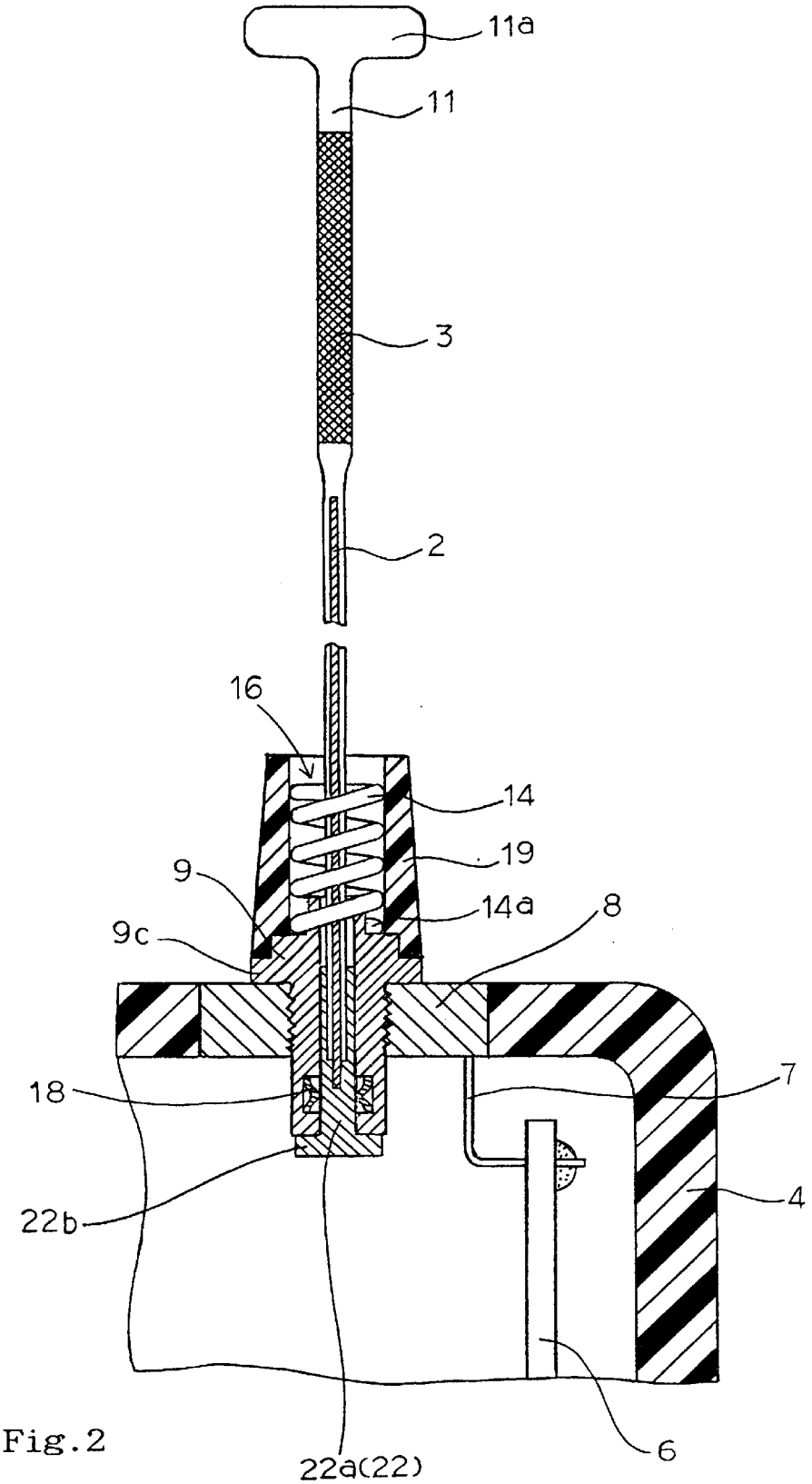
FIG. 2 is a sectional view of the principal part of the antenna assembly with the rod antenna unit held in its extended position.
Figure 3:
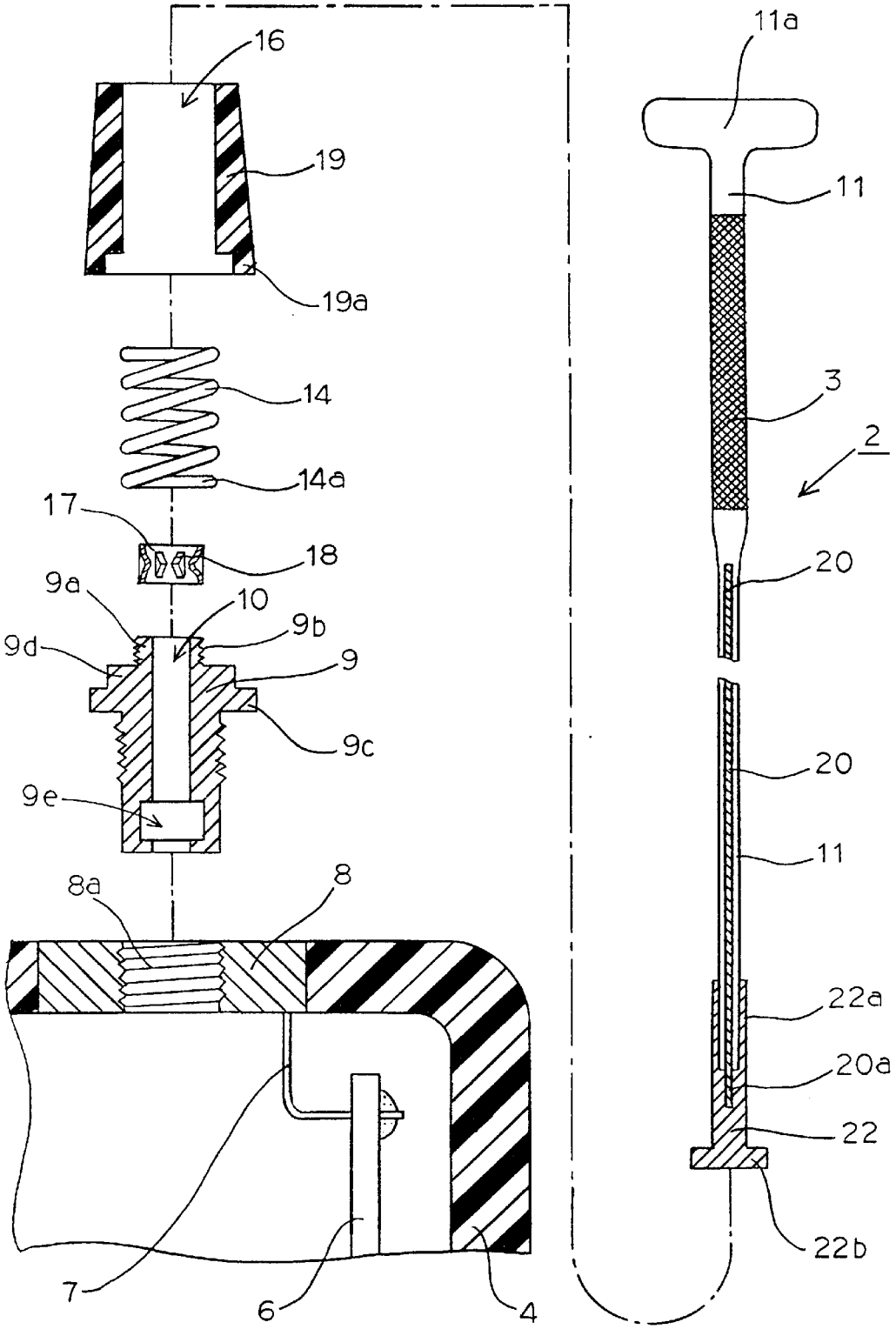
FIG. 3 is an exploded view showing, in section, respective parts of the antenna assembly of the FIG. 1 embodiment.

FIGS. 1 and 2 are sectional views illustrating the principal part of the antenna assembly with the rod antenna unit 2 held in its retracted and extended positions, respectively, and FIG. 3 an exploded sectional view showing respective parts of the antenna assembly.

In FIGS. 1 through 3, reference numeral 6 denotes a circuit board on which there are mounted high-frequency circuit elements (not shown) forming a sending circuit, a receiving circuit an antenna coupling circuit and similar circuit elements of the portable radio 5. The antenna coupling circuit on the circuit board 6 is electrically connected via a feeder 7 to a fixing ring 8 pressed in the top panel of the housing 4.

The ring 8 has a female screw thread 8 a cut in its hole for threaded engagement with feeding metal pipe 9. The feeding metal pipe 9 is mounted on the radio housing 4 by screwing it in the fixing ring 8 until a flange 9*c* protrusively provided on the outer peripheral surface of the hardware 8 abuts against the radio housing 4.

The feeding metal pipe 9 is a substantially cylindrical member which has a centrally-disposed through hole 10. The through hole 10 has about the same diameter as that of the rod antenna unit 2 so that the former slidably or telescopically receives the latter and supports it in its extended and retracted positions.

Figure 5:
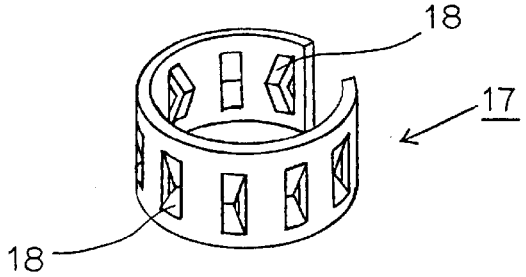
FIG. 5 is a perspective of a cylindrical spring structure 17 for use in the FIG. 1 embodiment.

The through hole 10 has cut therein an annular groove 9*e,* in which a cylindrical spring structure 17 shown in FIG. 5 is fitted.

The cylindrical spring structure 17 has a slit or cut extending widthwise across it so that it expands and contracts in its radial direction. In the annular groove 9*e* the cylindrical spring structure 17 is held in compressed form.

The cylindrical spring structure 17 has a plurality of equiangularly spaced contact springs 18 which protrude therefrom toward the center axis thereof for elastic contact with the rod antenna unit 2 inserted in the through hole 10.

To firmly retain a helical antenna element 14 at its one end 14*a* as depicted in FIG. 3, the upper cylindrical portion 9*a* of the feeding metal pipe 9 has an outside diameter equal to that of the winding structure of the helical antenna element 14 and is provided with a male screw thread 9*b* cut on the exterior peripheral surface with the same pitch as the winding pitch of the helical antenna element 14

The helical antenna element 14 serves as a secondary antenna in the present invention and is formed by a helical winding of a piano wire of a length equal to the quarter wavelength of signals to be received by the portable radio. For example, when the portable radio 5 is a land mobile radiotelephone or automobile telephone, the receiving frequency band ranges from 869 to 894 MHz, and accordingly, the piano wire is wound into a quarter-wave helical antenna so that it resonates at the center frequency f1 (881 MHz) of the above frequency band.

The diameter of the helical structure is sufficiently larger than the outside diameter of the rod antenna unit 2 so that the latter does not get in touch with the helical antenna element 14 when inserted thereinto as shown in FIG. 1.

Reference numeral 19 denotes a cylindrical insulating cap, which covers the entire structure of the helical antenna element 14 to protect it from external forces. The insulating cap 19 is made of synthetic resin such as hard plastic.

The base end portion 19*a* of the insulating cap 19 is bonded by an adhesive to a cylindrical mounting portion 9*d* of the feeding metal pipe 9 which is larger in diameter than the upper cylindrical portion 9*a;* namely, the insulating cap 19 is fixedly mounted on the flange 9*c* of the feeding metal pipe 9.

Figure 4:
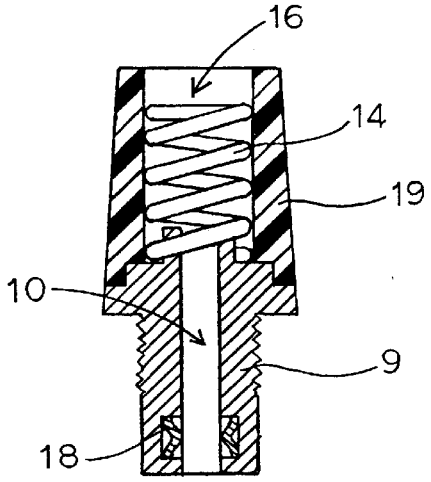
FIG. 4 is a sectional view showing an insulating cap 19 mounted on feeding hardware 19 in the FIG. 1 embodiment.

FIG. 4 shows the state in which the insulating cap 19 is mounted on the feeding hardware 9. As depicted in FIG. 4, the through hole 10 of the feeding metal pipe 9 and the helical antenna element 14 are axially aligned, through which the rod antenna unit 2 shown in FIG. 3 is inserted coaxially with them.

The rod antenna unit 2 is made up of a rod antenna element 20 serving as a primary antenna, an insulating cover 11 and a connector terminal 22.

The rod antenna element 20 is a linear structure of an elastic wire which has a length equal to the quarter wavelength of signals to be sent from the portable radio 5. For example, when the portable radio 5 is an automobile telephone, the transmit frequency band ranges from 824 to 849 MHz, and accordingly, the rod antenna element 20 is provided as a quarter-wave antenna which resonates at the center frequency f2 (836 MHz) of that frequency band.

Reference numeral 11 denotes a flexible insulating antenna cover, which covers the rod antenna 20 along the entire length except its lower end portion 20*a* to protect and electrically isolate it.

The insulating cover 11 is formed by molding an insulating elastomer such as synthetic rubber and its top end portion forms a stopper 11*a* larger in diameter than the through hole 16 of the insulating cap 19. Accordingly, when the rod antenna unit 2 is pushed into the radio housing 4, the stopper 11*a* abuts against the insulating cap 19 to ensure preventing the rod antenna unit 2 from dropping into the radio housing 4. The rod antenna unit 2 can be drawn out from the radio housing 4 to its extended position by picking up the stopper 11*a*.

Reference numeral 3 denotes a frequency adjusting or control conductor wrapped around the insulating cover 11 with which the contact springs 18 make elastic contact when the rod antenna unit 2 is held in its retracted position in the radio housing 4.

The frequency adjusting conductor 3 is formed by sheet metal easy to bend. Several kinds of frequency adjusting conductors 3 are prepared and a selected one of them is wrapped around the insulating cover 11 each time. In this way, the length of the frequency adjusting conductor 3 which serves as a conductor inside the helical antenna 14 changes, thereby adjusting the resonance frequency of the secondary antenna 14 when the contact springs 18 make electrical contact therewith.

By selectively using the several kinds of frequency adjusting conductors 3 to be wrapped around the insulating cover 11, the resonance frequency of the secondary antenna 14 can easily be made to match the receive frequency without cutting off the antenna 14.

Knurling the surface of the frequency adjusting conductor 3 increases the coefficient of statical friction with the contact springs 18, making it possible to snugly support the rod antenna unit 2 when it is retracted in the radio housing 4

As described later on, when the rod antenna unit 2 is in its extended position, the feeding metal pipe 9, linked to the secondary antenna 14, is connected also to the primary antenna 20, with the result that the resonance frequency of the secondary antenna 14 varies under the influence of the primary antenna 20. In this embodiment the resonance frequency of the secondary antenna 14 in the rod antenna extended state is adjusted by a selected one of the frequency adjusting conductors 3 to the receive frequency f1 (881 MHz) of the portable radio 4 also in the rod antenna retracted state in which the feeding metal pipe 9 is electrically disconnected from the primary antenna 20.

Incidentally, when the frequency adjusting conductors 3 are made of metal foil or the like, the resonance frequency could be adjusted by laying them one on top of another.

The material for the frequency adjusting conductors 3 need not always be limited specifically to the above-mentioned conductive materials such as sheet metal and metal foil, but polyethylene terephthalate or similar dielectric material can also be used, in which case the resonance frequency is adjusted by similarly changing the length of the frequency adjusting conductor 3 which is a dielectric inside the helical antenna 14.

The intermediate portion of the rod antenna unit 2 has its outside diameter slightly reduced to facilitate its vertical movement between the retracted and extended positions.

The rod antenna unit 2 has its lower end portion 20*a* fixedly coupled to the connector terminal 22 composed of a sheath-like support portion 22*a* and a stopper 22*b*. The rod antenna unit 2 and the connector terminal 22 are electrically interconnected.

The rod antenna element 20 is coupled to the connector terminal 22 by crimping the latter onto the lower end portion of the insulating cover 11 together with the rod antenna element 20 and then crimping the connector terminal 22 directly onto the lower end portion 20*a* of the rod antenna element 20.

The sheath or support portion 22*a* of the connector terminal 22 has an outside diameter larger than the intermediate portion of the rod antenna unit 2 so as to make elastic contact with the contact springs 18 when the rod antenna unit 2 is in its extended position.

The connector terminal 22 has at its lower extremity the stopper 22 formed by increasing the diameter of the support portion 22*a*. The diameter of the stopper 22*b* is larger than the diameter of the through hole 10 of the feeding metal pipe 9.

Accordingly, when the rod antenna unit 2 is drawn out from the radio housing 4 by picking up the stopper 11*a*, the stopper 22*b* abuts against the feeding metal pipe 9, preventing the rod antenna unit 2 from coming out of the radio housing 4.

When the stopper 22*b* abuts against the feeding metal pipe 9, the rod antenna unit 2 is fully extended and the support portion 22*a* of the connector terminal 22 is elastically pressed by the contact springs 18 to establish electrical connections therebetween (see FIG. 2.).

When the rod antenna unit 2 is in its fully extended position, the support portions 22*a* is inserted in the through hole 10 and supports the rod antenna unit 2 projecting out of the radio housing 4.

Next, a description will be given of the operation of the antenna assembly when the rod antenna unit 2 is in its retracted and extended positions As shown in FIG. 1, when the rod antenna unit 2 is held in its retracted position, the stopper 11*a* at the tip of the insulating cover 11 abuts against the insulating cap 19 and the rod antenna unit 2 is held in place in the radio housing 4.

At this time, the contact springs 18 elastically contact the frequency adjusting conductor 3 wrapped around the insulating cover 11 and supports the rod antenna unit 2 stable in its retracted position.

The frequency adjusting conductor 3 is electrically connected to the secondary antenna 14 via the contact springs 14 and the feeding metal pipe 9, making the resonance frequency of the secondary antenna 14 match the receive frequency of the portable radio 5. Hence, as shown in FIG. 7 (*a*), the secondary antenna 14 (the helical antenna element) and the frequency adjusting conductor 3 are electrically connected to the feeding hardware 9, and as shown in FIG. 7 (*c*), the secondary antenna 14 serves as a quarter-wave antenna that is tuned to the receive frequency f1 (881 MHz).

The secondary antenna 14 protrudes out of the radio housing 4 and has its resonance frequency tuned to the receive frequency, and hence it receives signals with high sensitivity.

On the other hand, the primary antenna (the rod antenna element) 20 is surrounded by the insulating cover 11, and hence it is not electrically connected to the feeding metal pipe 9 and the contact springs 18. Thus, the primary antenna 20 is completely isolated from the feeding metal pipe 9; during transmission the primary antenna 20 retracted in the radio housing 4 does not radiate high-frequency signals nor does it affect the secondary antenna 14 during reception.

Incidentally, as long as the rod antenna element 20, when retracted in the radio housing 4, lies below the feeding metal pipe 9, there is no fear of the former contacting the latter; therefore, the intermediate portion of the rod antenna element 20 need not always be covered with the insulating cover 11.

When drawing out the rod antenna unit 2 from the radio housing 4 until the stopper 22*b* of the connector terminal 22 abut against the feeding metal pipe 9 as shown in FIG. 2, the support portion 22 a of the connector terminal 22 comes into elastic contact with the contact springs 18.

In this state, the rod antenna element 20 is electrically connected to the feeding hardware 9 via the connector terminal 22 and the contact springs 22, whereas the frequency adjusting conductor 3 is no longer electrically connected to the secondary antenna 14.

Consequently, there is brought about such a state as shown in FIG. 7 (*b*) wherein the feeding metal pipe 9 is electrically connected to the quarter-wave primary antenna 20 having its resonance frequency adjusted to the transmit frequency f2 of the portable radio 5 and to the quarter-wave secondary antenna 14 having its resonance frequency adjusted to the receive frequency f1.

As depicted in FIG. 7 (*d*), the antenna assembly composed of the primary and secondary antennas 20 and 14 functions as a two-frequency antenna which resonates at the transmit frequency f2 (836 MHz) and the receive frequency f1 (881 MHz).

Since the primary and secondary antennas 20 and 14 both protrude from the radio housing 4 and resonate at the transmit and receive frequencies, respectively, the primary antenna 20 can output transmitting signals of large radiated power and the secondary antenna 14 can receive signals with high sensitivity.

Figure 8:
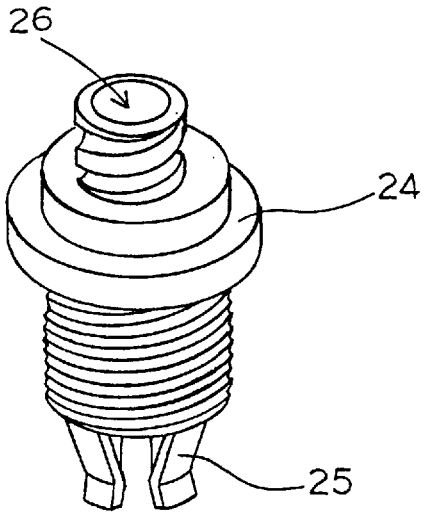
FIG. 8 is a perspective view of feeding metal pipe 24 for use in a second embodiment of the present invention.

FIG. 8 illustrates in perspective feeding metal pipe 24 for use in a second embodiment of the present invention. The feeding metal pipe 24 has contact springs 25 formed integrally therewith. The contact springs 25 are formed by a pair of opposed tongue-like segments each of which is circular-arc-shaped in cross section and is extended obliquely downward from the underside of the feeding metal pipe 24 toward its center axis and has its lower end portion bent outward. The contact springs 25 holds therebetween the rod antenna unit 2 and allows its smooth sliding movement.

Figure 9:
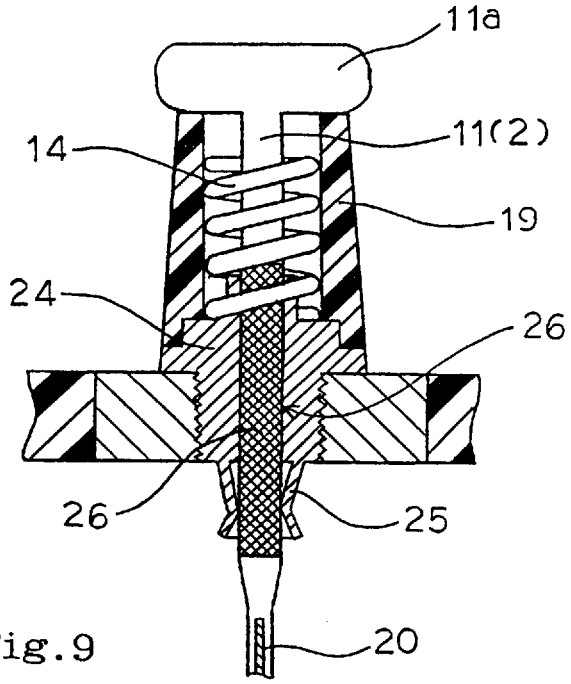
FIG. 9 is a sectional view showing the state in which a rod antenna unit 2 is inserted in feeding metal pipe 24 in the second embodiment.
Figure 10:
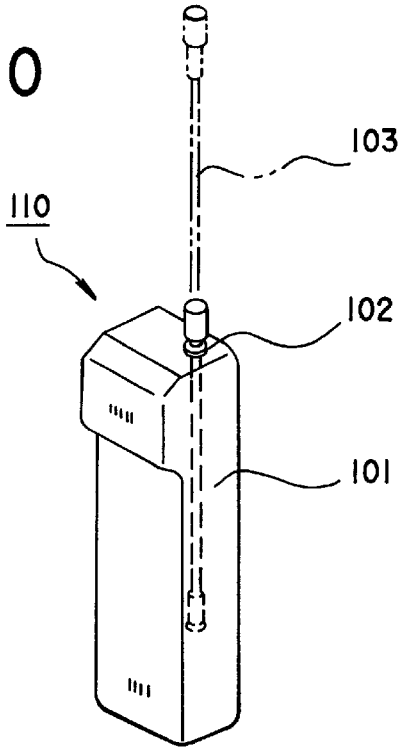
FIG. 10 is a perspective view of a portable radio 101 equipped with a conventional antenna assembly.
Figure 11:
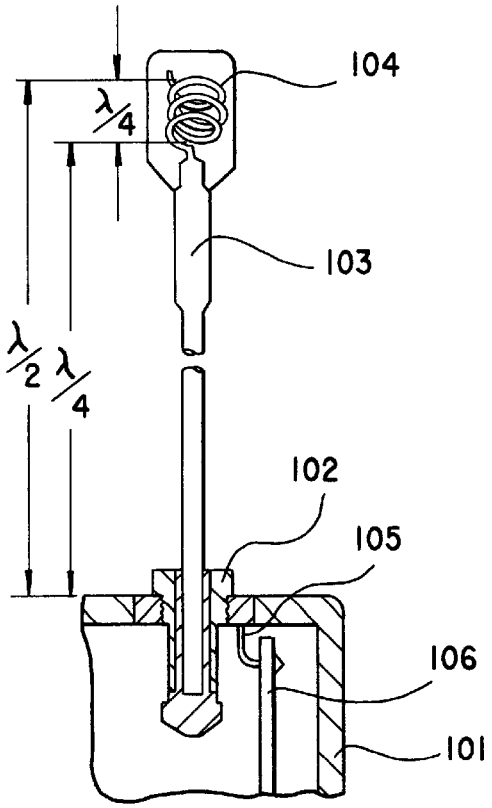
FIG. 11 is a sectional view of the conventional antenna assembly with its rod antenna unit held in its extended position.
Figure 12:
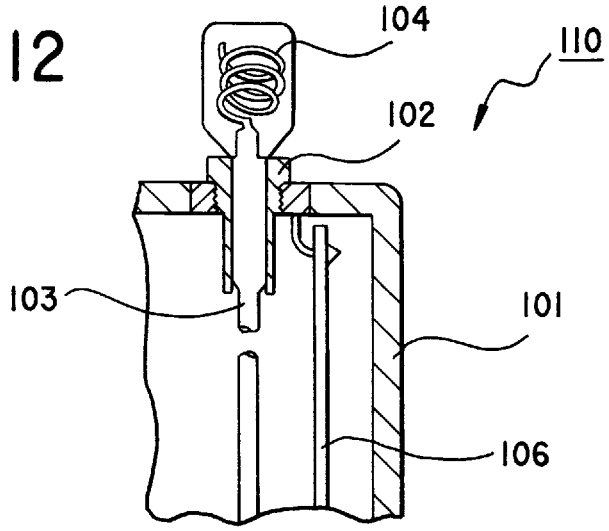
FIG. 12 is a sectional view of the conventional antenna assembly with the rod antenna unit held in its retracted position.
Figure 13:
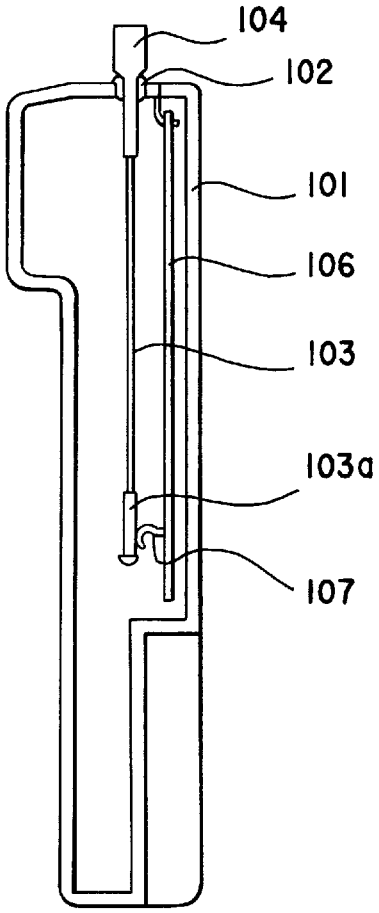
FIG. 13 is a schematic diagram showing the state in which a grounding segment 107 is held in contact with a rod antenna unit 103 in its retracted position.

FIG. 9 illustrates the principal part of an antenna assembly using the above-mentioned feeding metal pipe 24. The contact springs 25 are leaned toward the center axis of the feeding metal pipe 24 as described above, and hence they elastically contact the outer peripheral surface of the rod antenna unit 2 inserted in a through hole 26 of the feeding metal pipe 24. When the rod antenna unit 2 is in the retracted position, the contact springs 2 make electrical contact with the frequency adjusting conductor 3, and they make electrical contact with the support portion 22 a of the connector terminal 22 when the rod antenna unit 2 is in the extended position.

Thus, this embodiment produces the same effects as does the first embodiment Further, since the contact springs 25 are integral with the feeding metal pipe 24, the assembling of the antenna assembly of this embodiment is simplified with no increase in the number of parts used.

The present invention is not limited specifically to the above-described embodiments but may be modified in various ways. For example, while in the above, the frequency adjusting conductor 3 has been described to be used to prevent the resonance frequency of the secondary antenna 14 from differing between the rod antenna extended and retracted state, it is also possible to use the frequency adjusting conductor 3 by which the resonance frequency of the secondary antenna 14 having matched the receive frequency in the rod antenna extended state is switched to a resonance frequency between the transmit and receive frequencies f1 and f2 in the rod antenna retracted state.

By changing its resonance frequency as mentioned above, the secondary antenna 14 receives signals with high sensitivity when the rod antenna unit 2 is in the extended position and it is allowed to transmit and receive signals when the rod antenna unit is in the retracted position.

Further, although in the above the primary antenna 20 has been described to be a quarter-wave antenna, it may also be formed by a non-grounded type half-wave or ⅝-wave rod antenna.

Additionally, the contact springs need not always be tongue-like segments but may be provided in any form as long as they elastically contact the outer peripheral surface of the rod antenna unit 2; for example, the contact springs can be formed by some inward swellings of the feeding metal pipe.

It will be apparent that many modifications and variations may be effected without departing from the scope of the novel concepts of the present invention

I claim:

1. An antenna assembly comprising:

a rod antenna unit composed of a primary antenna formed by a rod antenna element, an insulating cover covering said primary antenna at least at its lower end portion, and a connector terminal secured to said lower end portion of said primary antenna, said primary antenna, said insulating cover and said connector terminal being axially aligned;

feeding metal pipe fitted in a top of a radio housing, and having a centrally-disposed through hole for slidably receiving said rod antenna unit between its extended and retracted positions, and contact springs for elastically contacting an outer peripheral surface of said rod antenna unit;

a secondary antenna formed by a helical antenna element and fixed at its lower end to said feeding metal pipe, characterized in that when said rod antenna unit is retracted in said radio housing, said contact springs contact said insulating cover around said rod antenna unit, cutting off electrical connections between said feeding metal pipe and said primary antenna; and also characterized in that when said rod antenna unit is drawn out of said radio housing to said extended position, said contact springs electrically contact said connector terminal of said rod antenna unit, electrically connecting said primary antenna and said secondary antenna to said feeding metal pipe; and a frequency adjusting conductor, wherein said frequency adjusting conductor is wrapped around said insulating cover for contact with said contact springs to adjust a receiving frequency of said secondary antenna when said rod antenna unit is retracted into said radio housing.

2. The antenna assembly of claim 1, characterized in that a cylindrical insulating cap is mounted on said feeding metal pipe around said secondary antenna and that an upper end portion of said insulating cover forms a stopper larger in diameter than a through hole of said insulating cap.

3. The antenna assembly of claim 1, characterized in that said connector terminal is composed a support portion for insertion into said through hole and a stopper larger in diameter than said support portion and that when said rod antenna unit is drawn out of said radio housing to said extended position, said stopper abuts against a lower end face of said feeding metal pipe.

4. The antenna assembly of any one of claims 1 to 3, characterized in that said contact springs are protrusive inwardly from a body of a cylindrical spring structure and that said cylindrical spring structure is fitted in an annular groove cut in an interior surface of said feeding metal pipe.

5. The antenna assembly of any one of claims 1 to 3, characterized in that said contact springs are each a tongue shaped segment formed integrally with said feeding metal pipe and extending therefrom in a cantilever fashion for elastic contact with an outer peripheral surface of said rod antenna unit.

* * * * *